US007506834B2

(12) United States Patent
Lenkl

(10) Patent No.: US 7,506,834 B2
(45) Date of Patent: Mar. 24, 2009

(54) WINDING APPARATUS WITH CENTRAL LOCKING AND UNLOCKING

(75) Inventor: Johannes Lenkl, Freising (DE)

(73) Assignee: Avery Dennison Corporation, Pasadena, CA (US)

( * ) Notice: Subject to any disclaimer, the term of this patent is extended or adjusted under 35 U.S.C. 154(b) by 323 days.

(21) Appl. No.: 11/323,304

(22) Filed: Dec. 30, 2005

(65) Prior Publication Data

US 2007/0125899 A1 Jun. 7, 2007

(30) Foreign Application Priority Data

Dec. 1, 2005 (DE) ..... 20 2005 018 808 U

(51) Int. Cl.
*B65H 75/24* (2006.01)

(52) U.S. Cl. ..... 242/573.7; 242/597.1

(58) Field of Classification Search ..... 242/571, 242/572, 573, 573.1, 573.2, 573.3, 573.7, 242/573.9, 597, 97.1, 597.3, 597.5, 597.6, 242/599, 599.4, 597.1

See application file for complete search history.

(56) References Cited

U.S. PATENT DOCUMENTS

| | | | | |
|---|---|---|---|---|
| 1,668,990 A | | 8/1928 | Tromblay | |
| 2,591,730 A | * | 4/1952 | Sendzimir | 242/573.3 |
| 2,733,873 A | * | 2/1956 | Petersen | 242/573.9 |
| 2,882,078 A | | 4/1959 | MacDonald | |
| 3,857,526 A | | 12/1974 | Dischert | |
| 4,613,092 A | * | 9/1986 | Nakai et al. | 242/573.9 |
| 4,668,990 A | * | 5/1987 | Kondo et al. | 348/304 |
| 4,747,555 A | * | 5/1988 | Bosco et al. | 242/574.4 |
| 6,095,704 A | * | 8/2000 | Jaeger et al. | 400/613 |

FOREIGN PATENT DOCUMENTS

| | | |
|---|---|---|
| DE | 888 359 | 8/1953 |
| DE | 1 205 792 | 11/1965 |
| DE | 33 39 977 A1 | 5/1985 |
| DE | 3339977 | 5/1985 |
| GB | 746693 | 3/1956 |
| GB | 746694 | 3/1956 |

OTHER PUBLICATIONS

English Abstract for DE 888 359 listed above previously filed.
English Abstract for DE 1 205 792 listed above previously filed.
German Search Report dated Jul. 6, 2006 for German priority application 20 2005 018 808.5.

* cited by examiner

*Primary Examiner*—Peter M Cuomo
*Assistant Examiner*—William E Dondero
(74) *Attorney, Agent, or Firm*—Joseph J. Grass

(57) ABSTRACT

A winding apparatus for a winding material. A drivable rotary shaft having a longitudinal center line (M). A receiving unit for the winding material, which is rotationally connected to the rotary shaft. A clamping unit for reversibly clamping the winding material fast to the rotary shaft. An actuation unit. The clamping unit can be reversibly moved from its clamping position into its release position by at least one translatory movement of the actuation unit.

11 Claims, 3 Drawing Sheets

DETAIL B

WINDING APPARATUS WITH CENTRAL LOCKING AND UNLOCKING

CROSS-REFERENCE TO RELATED APPLICATION

Figure 1:
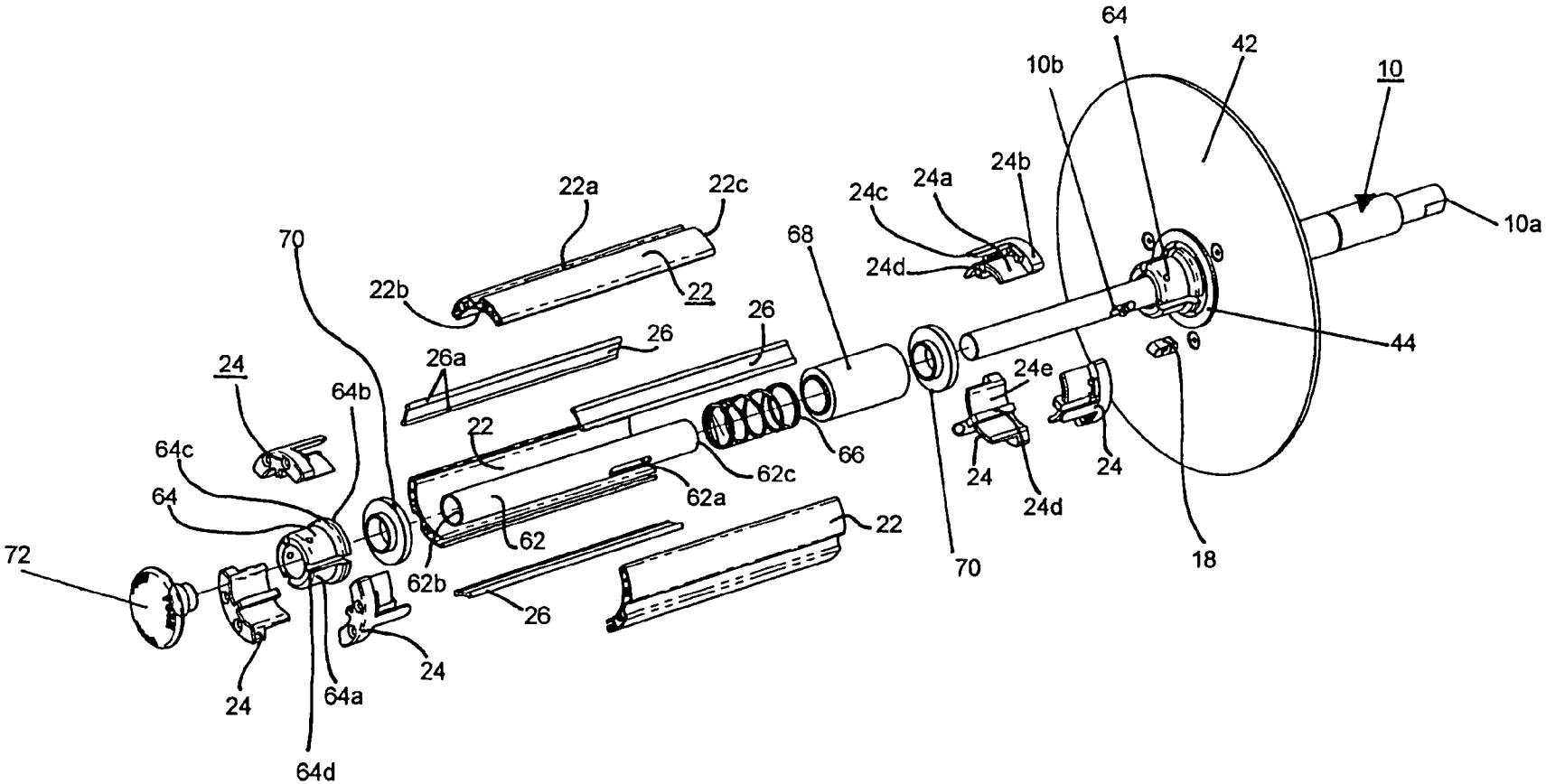

This application claims priority of German Patent Application Number DE 20 2005 018 808.5, filed on Dec. 1, 2005.

The present invention concerns a winding apparatus for winding up and unwinding a winding material, in particular vacant label-carrier strips. In particular that winding apparatus has a drivable rotary shaft which has a longitudinal centre line, a receiving unit for the winding material, a clamping unit for reversibly clamping the winding material fast to the receiving unit and an actuation unit.

It is frequently necessary in practice for a vacant or empty article to be wound up, after use of the element which was previously carried by the vacant article. That can be the case for example with self-adhesive labels which are provided with an adhesive layer at their rear side and which, in order to avoid the labels sticking together, are arranged on a label-carrier strip in succession with or without a spacing therebetween. In that case the surface of the label-carrier strip is provided with a layer which on the one hand permits the self-adhesive labels to be securely fixed on the carrier strip but which on the other hand allows the label to be easily pulled off the carrier strip. After removal of the label from the carrier strip the vacant label-carrier strip must be wound up in order to avoid the uncontrolled occurrence of waste. That is effected with a winding apparatus in which, at the beginning of use of the self-adhesive labels or the carrier strip provided with self-adhesive labels, the leading end of that strip is clamped. When now the self-adhesive labels are progressively pulled off the carrier strip or dispensed, the winding apparatus correspondingly winds up the vacant label-carrier strip. As the length of such carrier strips can be up to 1000 m, a winding consisting of the vacant label carrier strip, which is of considerable diameter and weight, is thus produced in the course of time. As the winding apparatus is preferably connected to a motor drive which exerts a defined tensile stress on the vacant label-carrier strip, the winding which is formed from the vacant label-carrier strip is wound up taut, with a comparatively high level of stress. As the vacant label-carrier strip is wound up directly on to the receiving unit of the winding apparatus, the problem which arises is that of being able to easily withdraw the resulting winding consisting of the vacant strip material, from the winding apparatus.

The object of the present invention is to provide a winding apparatus of the kind set forth in the opening part of this specification, which permits quick and easy removal of the winding material.

As, for example in comparison with a rotary movement, a translatory movement is a simple movement which is also simple to produce, the proposal according to the invention, that the clamping unit can be reversibly taken from its clamping position into its release position by at least one translatory movement of the actuation unit, affords the possibility of being able to remove the winding material from the winding apparatus easily and quickly and in that case to use a winding apparatus of a simple structure. In that respect the translatory movement of the actuation unit can be of a multi-stage nature; for example the clamping unit can be moved out of the clamping position into a release readiness position and from there into the actual release position. If the clamping unit is moved from the clamping position into the release position and vice-versa by means of a single-stage translatory movement of the actuation unit, removal of the winding material from the winding apparatus is a quick and easy operation, while the structure of the winding apparatus can also be simple.

In order to be able to implement removal of the winding material from the winding apparatus in a quick and simple procedure, it is further advantageous if the actuation unit is arranged centrally and preferably coaxially with respect to the rotary shaft. That provides a space-saving configuration for the winding apparatus according to the invention. In that case for example the actuation unit can have an actuation element, preferably an actuation knob, which can be easily accessibly actuated from the exterior upon removal of the winding material from the winding apparatus. In that case the removal operation can be effected by a preferably single push or pressure actuation or pull actuation of the actuation unit.

So that the winding apparatus according to the invention can be of a compact nature, it is further advantageous if the clamping unit at least partially forms the receiving unit for the winding material. If for example the receiving unit is formed by a sleeve arranged in coaxial relationship with the rotary shaft the clamping unit can be part of that sleeve. In this connection it is also advantageous if the clamping unit is at a radial spacing relative to the rotary shaft.

If the clamping unit is elastically, preferably resiliently, biased in the direction of the clamping position, the translatory movement to move the clamping unit from the clamping position into the release position can be enabled by a simple pushing or pulling movement against the action of the bias. In that case the biasing can be so adjusted that the residual tension in the coil of material or the winding material prevents independent return movement of the clamping elements into the clamping position until the winding material has been completely removed. Supplemental or alternatively thereto there is also the possibility that, after actuation of the actuation unit to move the clamping unit from the clamping position into the release position, the weight of the winding material is sufficient to hold the clamping unit in the release position. In that respect it is advantageous if the biasing is adjustable to be able to set the winding apparatus according to the invention to the differing weight of the winding material.

In addition the clamping unit automatically moves back into the clamping position due to the elastic biasing as soon as the actuation unit is released and/or the winding material is withdrawn from the receiving unit. That can provide for example that unintentional release of the winding material from the apparatus is prevented.

A particularly simple structure for the clamping unit is afforded if the clamping unit has at least one movable clamping element which is preferably reversibly biased into the clamping position and which is reversibly movable into a release position by means of the actuation unit. In order in that case to have to cover the shortest possible distance between the clamping position and the release position, it is further advantageous if the clamping element is reversibly movable from the clamping position into the release position at least approximately perpendicularly with respect to the longitudinal axis of the rotary shaft.

So that the clamping element and therewith the winding material occupy a defined position with respect to the rotary shaft, it is further advantageous if the clamping element is fixed axially with respect to the rotary shaft.

As has already been mentioned hereinbefore, the biasing of the clamping unit or the clamping element can be of a resilient nature. In that respect it is possible to use both one and also a plurality of spring elements. It is advantageous if the clamping element is biased into the clamping position by means of at least one spring element, preferably a compression spring.

In principle the clamping element can be of any suitable cross-sectional shape. As already mentioned hereinbefore the clamping unit can form at least a part of the receiving unit for the winding material. Particularly in such a case it is advantageous if the clamping element is in cross-section at least approximately in the form of a segment of a circle with preferably a circular segment angle of at least approximately 120°, with respect to the longitudinal centre line of the rotary shaft.

If the clamping element is at a radial spacing relative to the rotary shaft, there is the possibility that the actuation unit, the clamping unit and/or the receiving unit can be arranged in mutually coaxial relationship fitted one within the other. That provides that the winding apparatus according to the invention is of a particularly compact nature.

In order to be able to provide for example the clamping element with a radial spacing relative to the rotary shaft and in order to be able to arrange at least parts of the actuation unit in the radial direction between the clamping element and the rotary shaft, it is further advantageous if, at each of its ends, the clamping element has a respective carrier element, by means of which it is in contact with the actuation unit. Basically it is possible to provide only one respective carrier element for each clamping element. That can be the case in particular when the clamping element is only of a short axial length, in particular in comparison with the receiving unit, so as to guarantee non-tilting movement of the clamping element. If however the clamping element forms a part of the receiving unit, it is advantageous, as stated, if the clamping element preferably has a respective carrier element at each of its ends.

As mentioned hereinbefore, the clamping element can implement a movement perpendicularly to the longitudinal centre line of the rotary shaft or in a radial direction, to achieve the release position. In order to prevent the ingress of foreign bodies into the gap which is formed in that situation, it may further be advantageous if the carrier element has a first receiving means for the clamping element and a second receiving means for an intermediate element which is arranged radially inwardly with respect to the clamping element. That intermediate element can cover the gap in a slat-like fashion. Alternatively or supplemental thereto the intermediate elements can also be used to join the clamping elements together so that the clamping elements are held in the peripheral direction.

If the clamping unit has only one clamping element, then upon removal of the winding material from the receiving unit the actuation unit must be constantly actuated unless the rotary shaft assumes a rotary position in which the clamping element is held in the release position by the winding material after release by the actuation unit, as a consequence of the residual tension in the winding material and/or the own weight of the winding material, that is to say if the clamping element is not in the upper rotary position. In order to be able to remove the winding material irrespective of the rotary position of the rotary shaft, it is advantageous if the clamping unit has a plurality of and in particular three clamping elements which are preferably of the same axial length and which together form a hollow shaft arranged in coaxial relationship with the rotary shaft.

In order to be able to convert the translatory movements of the actuation unit into a movement which takes place at least approximately in a radial direction, it is further advantageous if the actuation unit includes at least one conversion element for reversibly converting a translatory movement in at least approximately parallel relationship with the longitudinal centre line of the rotary shaft into a movement in at least approximately perpendicular relationship to the rotary shaft. In that arrangement the conversion element can be in direct or indirect contact with the clamping element. It is preferred if the conversion element is in contact, preferably in touching contact, with the clamping element. In that case the conversion element can be in contact with the clamping element by way of the carrier element.

The most widely differing shapes and configurations can be adopted for the conversion element. It is advantageous if the conversion element is formed by a sliding block which is displaceable in at least approximately parallel relationship with the longitudinal centre line of the rotary shaft reversibly from a clamping position into a release position and which has at least one cam surface which is in contact with the clamping element.

In that case the cam surface can once again be of the most widely varying configurations. Thus for example the cam surface can be formed throughout by an inclined plane, along which the clamping element slides from the clamping position into the release position and vice-versa. So that the clamping element reliably assumes a defined position in the release position and in the clamping position, it is advantageous if the cam surface of the sliding block has a first and a second cam surface portion which extend in at least approximately parallel relationship with the longitudinal centre line of the rotary shaft and which are connected by way of a third cam surface portion extending at an acute angle relative to the longitudinal centre line of the rotary shaft. In that case the first and the second cam surface portions which are spaced from each other both in the radial direction and also in the axial direction respectively define the clamping position and the release position. The sliding block passes along the third cam surface portion extending at an acute angle relative to the longitudinal centre line of the rotary shaft during the movement of the sliding block from the clamping position into the release position and vice-versa.

In order to provide a non-tilting movement of the clamping element, it is advantageous if the actuation unit has two respective conversion elements for each clamping element. They can be arranged at the respective ends of the clamping element. In particular those two conversion elements can be arranged with a respective carrier element which can also be provided at the end of the clamping element.

In order to move the clamping element from the clamping position into the release position and possibly also vice-versa, it is advantageous if the actuation unit has an actuation element, preferably an actuation knob, which is operatively connected to the conversion element. In that case the actuation element can be a push or pull knob arranged at the end of the rotary shaft. That affords the possibility that, after the end of the winding-on operation, the actuation unit can be actuated in an easier manner, being readily accessible from the exterior.

As the conversion element performs a translatory movement to move the clamping element from the clamping position into the release position and vice-versa, it is advantageous if the actuation unit has an intermediate sleeve which is preferably arranged in coaxial relationship with the longitudinal centre line of the rotary shaft and which carries the conversion element. In that way, irrespective of the choice of material for the conversion element, it is possible to select a material for the intermediate sleeve, which has a low coefficient of friction. That is for the reason that the conversion element, together with the intermediate sleeve, slides along the rotary shaft in the movement of the clamping element from the clamping position into the release position and vice-versa.

So that the intermediate sleeve can reliably perform its function, it is further advantageous if the intermediate sleeve is non-rotatably but axially movably connected to the rotary shaft. At the same time the intermediate sleeve should be operatively connected to the actuation element and should preferably be axially fixedly connected to the actuation element.

If the clamping unit is resiliently biased into the clamping position, the spring provided for that purpose can be pushed coaxially on the intermediate sleeve. That again provides a compact structure. In that arrangement the spring element of the clamping device can be arranged between two conversion elements of the actuation unit. So that the spring element can apply the biasing force to the clamping element, it is advantageous if the spring element can be supported on the intermediate sleeve. It is possible for that purpose to provide a corresponding support element which for example is formed by a support ring which is non-rotatably and axially fixedly connected to the intermediate sleeve.

In order to produce a winding with at least approximately straight side surfaces in a winding-up operation, the receiving unit can have a contact disc. It is advantageous in that respect if the contact disc has a recess into which the actuation unit can at least partially engage during its translatory axial movement in order to move the clamping element out of the clamping position into the release position. As has already been explained hereinbefore, the actuation unit can be arranged concentrically in the hollow shaft formed by the clamping unit and/or the receiving unit. Upon actuation of the actuation unit therefore a part of the actuation unit issues at an end out of the hollow shaft formed by the clamping unit and/or the receiving unit. The recess in the contact disc serves to receive those parts of the actuation unit.

Operation with the winding apparatus according to the invention can be as follows. This procedure is also to be deemed to be part of the present invention:

At the beginning for example of a winding-up operation, the leading end of the winding material, for example the leading end of a label-carrier strip, is clamped into the clamping unit in order to wind up the vacant or empty label-carrier strip from which the labels have been dispensed. That is effected by the leading end being threaded on to projections or raised portions provided on the carrier elements. Then, some revolutions which are effected by hand or by means of the drive of the winding apparatus provide that the label-carrier strip is fixed on the clamping unit or the receiving unit, and it is ready for the winding-up operation.

During the winding-up operation the clamping elements and the carrier elements are arranged in the clamping position, that is to say the conversion elements are disposed with their collar underneath the carrier elements. When the winding-up operation is concluded, the actuation knob is actuated, whereby the intermediate element is displaced towards the right against the compression force of the spring in the direction of the contact disc. The right-hand end of the intermediate sleeve and the right-hand conversion element pass in that case into the recess in the contact disc. At the same time the two conversion elements are displaced towards the right with respect to the carrier elements, whereby the second cam surface portion comes out of touching contact with the carrier elements. The carrier elements slide along the third cam surface portion and finally pass on to the first cam surface portion. In that way the clamping elements and the carrier elements can move radially inwardly in a direction towards the rotary shaft. In that situation the diameter of the receiving unit is once again reduced. As in that way the outside diameter of the receiving unit or the clamping unit is smaller than the inside diameter of the winding material, the wound-on material can be easily withdrawn towards the left from the receiving unit or the clamping unit. As the weight of the winding material continues to urge the clamping elements and the carrier elements downwardly, that is to say against the pressure force of the compression spring, the actuation knob does not need to be further pressed in that case. After removal of the winding material the pressure force of the compression spring is sufficient to move the two conversion elements together with the intermediate sleeve towards the left, whereby once again the second cam surface portion passes under the carrier elements. As a result the clamping elements and the carrier elements are moved back into the starting position, that is to say the clamping position.

Figure 2:
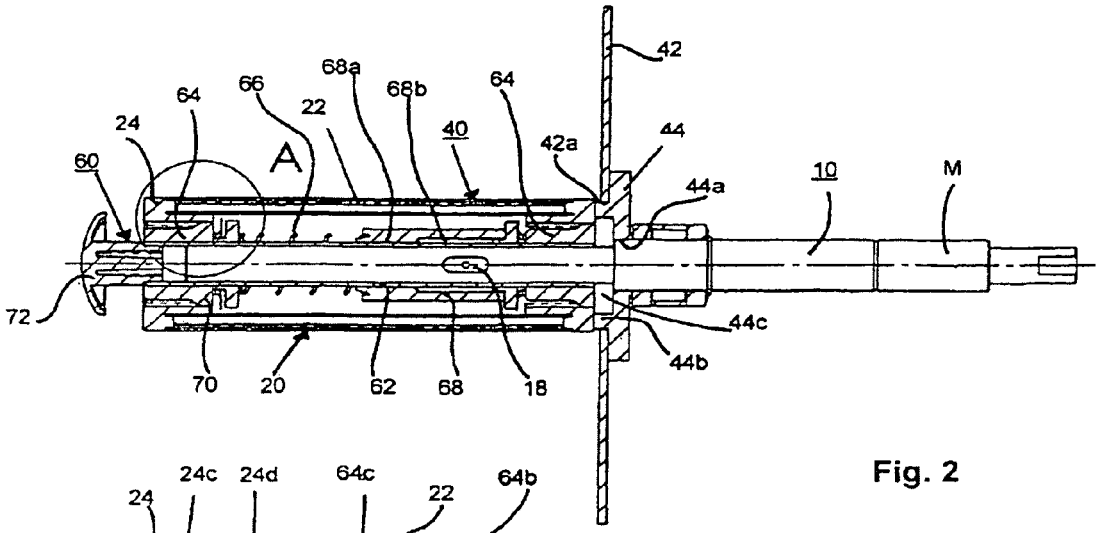
Figure 3:
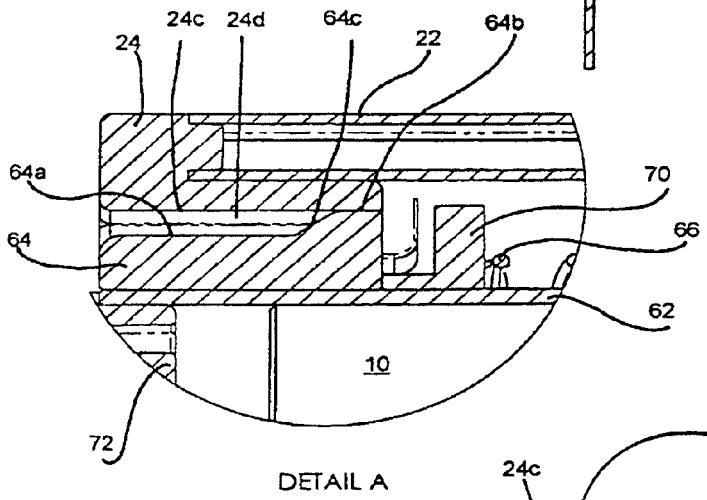
Figure 4:
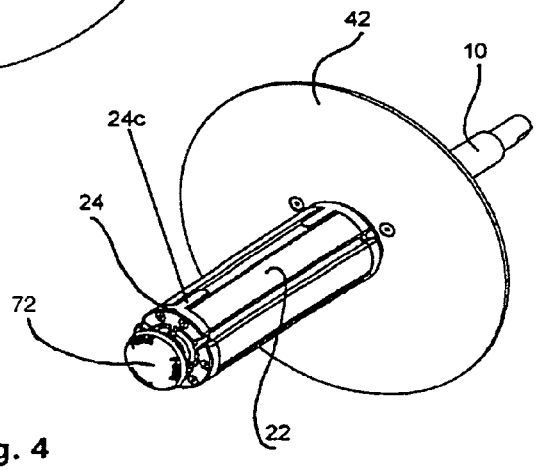
Figure 5:
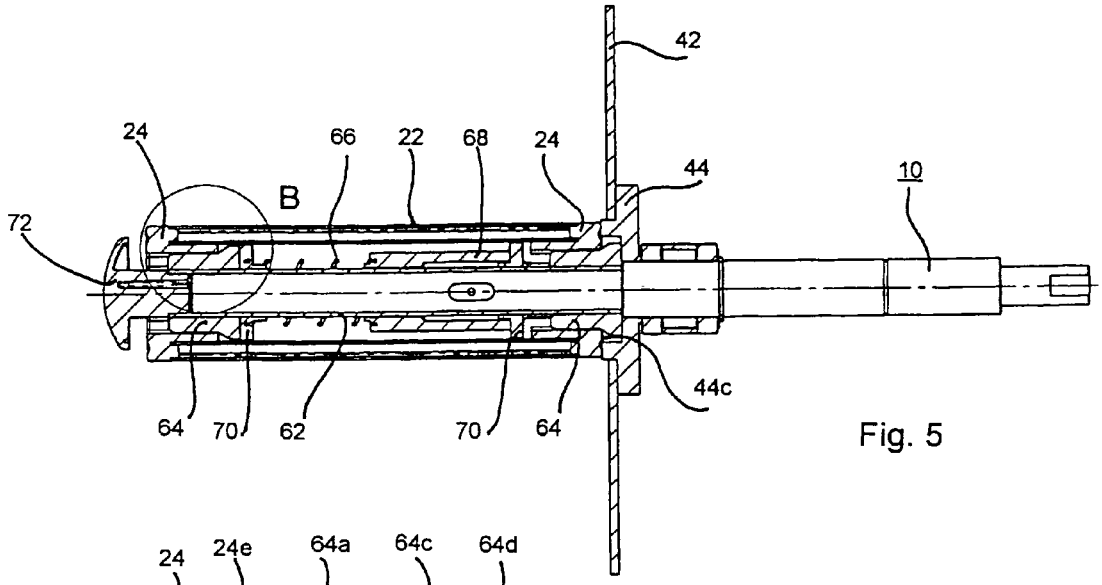
Figure 6:
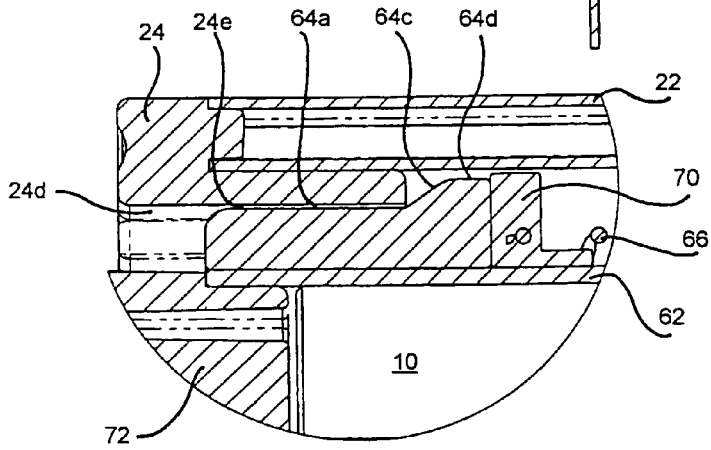
Figure 7:
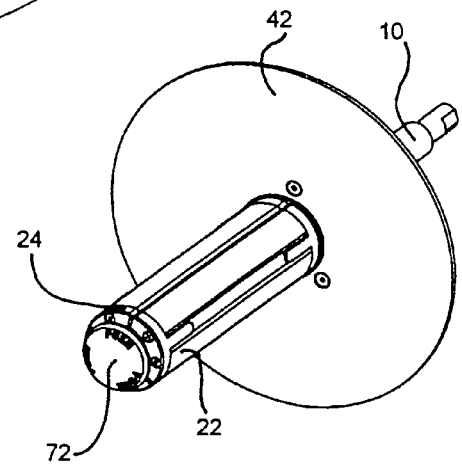

Further advantageous configurations and an embodiment by way of example are described hereinafter with reference to the drawings. The terms used in that respect 'left', 'right', 'down' and 'up' relate to the accompanying Figures in an orientation at which the references and the Figure identifications are readable normally. In the drawings:

FIG. 1 shows an exploded view of the winding apparatus according to the invention, FIG. 2 shows a longitudinal section through the winding apparatus according to the invention in the clamping position thereof, FIG. 3 shows a view on an enlarged scale of the detail A in FIG. 2, FIG. 4 shows a perspective view of the winding apparatus in its clamping position, FIG. 5 shows a view similar to FIG. 2 of the winding apparatus according to the invention, but in the release position thereof, FIG. 6 shows a view on an enlarged scale of the detail B in FIG. 5, and FIG. 7 shows a perspective view of the winding apparatus in the release position thereof.

The winding apparatus according to the invention comprises as its main components a rotary shaft 10 having a longitudinal centre line M, a clamping unit 20, a winding material receiving unit 40 and an actuation unit 60 (see FIGS. 1 and 2). Those main components are described in greater detail hereinafter with reference to the drawings.

As can be seen in particular from FIG. 1 the rotary shaft 10 is of a circular cross-section and is preferably made from steel. In the region to the right of the plane of symmetry (not shown) which extends therefrom perpendicularly to the longitudinal centre line M, the rotary shaft 10 has two shaft steps (not shown). Furthermore at its right end 10*a* it can be connected to a motor (also not shown) which can be used to drive the winding apparatus in known fashion.

As can be seen from FIG. 2, to the left of the plane of symmetry of the rotary shaft 10, which extends perpendicularly to the longitudinal central plane M, the clamping element 20 is arranged in concentric relationship with the rotary shaft. The clamping unit 20 has three clamping elements 22, six carrier elements 24 carrying the clamping elements 22 and three intermediate elements 26 (see FIG. 1). The functionally identical component parts of the clamping unit 20, that is to say therefore the clamping elements 22, the carrier elements 24 and the intermediate elements 26 are each of the same respective structure so that hereinafter only a respective one of those elements 22, 24 and 26 will be described in greater detail as being representative for the other functionally identical elements 22, 24 and 26.

A clamping element 22 is preferably made from an aluminium hollow profile and is in the shape of a segment of a circle in cross-section, that is to say in a cross-sectional area perpendicular to the longitudinal centre line M of the rotary shaft 10. The angle of the segment of the circle is at least approximately 120° with respect to the longitudinal centre line M of the rotary shaft. Provided at the apex point of each circular segment of the clamping element 22 is a respective U-shaped depression 22*a* which extends over the entire length of the clamping element 22 and which, in the installed condition of the clamping element 22, extends in at least approximately parallel relationship with the longitudinal centre line M of the rotary shaft 10.

At its left and right ends 22*b*, 22*c* the clamping element 22 is non-rotatably and axially fixedly connected to a carrier element 24. Each carrier element 24 in cross-section is also in the form of a segment of a circle, wherein the angle of the segment of the circle of the carrier element 24 is at least approximately identical to the angle of the segment of the circle constituted by the clamping element 22, that is to say therefore in the present embodiment by way of example the carrier element 24 has an angle for the segment of the circle of at least approximately 120°.

A carrier element 24 has two portions: a first portion 24*a* which in the installed condition of the carrier element 24 faces towards the clamping element 22 and is in the shape of a portion of the wall of a cylinder, and a second portion 24*b* which directly adjoins the first portion 24*a* and which in the installed condition of the carrier element faces away from the clamping element 22 and is in the shape of an annular collar. In that arrangement the radial height of the second portion 24*b* or the collar is such that it at least approximately corresponds to the radial thickness or height of the clamping element 22 so that in the assembled condition of the clamping element 22 to its two carrier elements 24, the result is an outwardly facing cylindrical surface which is uniform throughout.

Formed integrally on the collar 24*b* in the region of the apex point of each carrier element 24 which is in the form of a segment of a circle is a respective extension 24*c* which in the assembled condition faces in the direction of the clamping element 22. As can also be seen from FIG. 1 the extension 24*c* is at a radial spacing relative to the first portion 24*a*, which is disposed therebeneath, of the carrier element 24, and at its free end, that is to say the end which in the installed condition faces towards the clamping element 22, it has a chamfer or bevel (not identified).

As can be see for example from FIG. 6 or FIG. 7, the extension 24*c* serves to engage into the recess 22*a* of the clamping element 22, in the finished assembled winding apparatus. That provides that the clamping element 22 is fixed in position between the extension 24*c* and the top side of the first portion 24*a* of the carrier element 24. In addition the carrier element 24 can be connected to the clamping element 22 by means of preferably self-tapping screws (not shown) which can pass into engagement with the clamping element 22 through screw holes (also not identified in greater detail) in the second portion 24*b* of the carrier element 24 (there are two screw holes in the illustrated embodiment).

In addition at the inside of the first portion 24*a* or at the side 24*e* which in the installed condition faces towards the rotary shaft 10, each carrier element 24 has a respective leg 24*d* which extends over the entire axial length of the carrier element 24, that is to say in the installed condition parallel to the longitudinal centre line M of the rotary shaft 10. The leg 24*d* is of a rectangular cross-section and, as will also be described in greater detail hereinafter, serves for torque transmission or guidance of a conversion element 62 of the actuation unit 60. As can be seen inter alia from FIG. 1 the leg 24*d* projects beyond the carrier element 24 in the direction of the clamping element 22 and has a chamfer or bevel (not identified) at its end which in the installed position faces towards the rotary shaft 10 and the clamping element 22.

Provided on the collar 24*b* on both sides of the extension 24*c*, on the side facing in the direction of the clamping element 24 in the installed condition, are two raised portions (not identified) which serve for gripping the material or the winding article.

In addition the clamping unit 20 has three intermediate elements 26 which are formed by elongate sheet strips, for example of plastic material, wherein the edges facing in the longitudinal direction have thickened portions 26*a*. The intermediate elements 26 are of the same axial length as the clamping elements 22 and serve to provide that the clamping elements 22 are held together in the peripheral direction and/or in the clamping position of the clamping unit 20 no foreign bodies can penetrate into the intermediate space which is formed in that case between two clamping elements 22 disposed in succession in the peripheral direction.

The winding apparatus according to the invention further includes a winding material receiving unit 40 for receiving the winding material to be wound up or unwound. In the present embodiment this is formed by the three clamping elements 22, the six carrier elements 24 and by a winding material contact disc 42 and a cover disc 44 provided on the winding material contact disc 42 (see FIGS. 1 and 2).

The winding material contact disc 42 is arranged to the right of the clamping unit 20 in concentric relationship with the rotary shaft 10. The axial position thereof approximately corresponds to the plane of symmetry extending vertically relative to the longitudinal centre line M of the rotary shaft 10. As can be seen from FIG. 1 the winding material contact disc 42 is in the form of a circular surface. Provided in the region of the centre point of the circular surface of the winding material contact disc 42 is a through aperture 42*a* which is also circular and which is oriented in concentric relationship with the centre point of the contact disc 42 and through which the rotary shaft 10 passes. The diameter of the through aperture 42*a* is markedly larger than the outside diameter of the rotary shaft 10, as can be seen from FIG. 2.

As already mentioned hereinbefore, there is also a cover disc 44 which covers over the aperture 42*a* which is markedly larger in comparison with the rotary shaft 10, the winding material contact disc 42 being supported on the rotary shaft 10 by means of the cover disc 44. For that purpose the cover disc 42 has a circular aperture 44*a* which is arranged in the region of its centre point in concentric relationship with the central axis (not identified) of the cover disc 44. The diameter of the aperture 44*a* at least approximately corresponds to the outside diameter of the rotary shaft 10.

The cover disc 44 further has an annular collar 44*b* which is also arranged in concentric relationship with its centre point and which is integrally formed at the side of the cover disc 44, which in the installed condition faces towards the clamping unit 20. As can be seen for example from FIG. 2 the axial length of the annular collar 44*b* is larger than the thickness of the winding material contact disc 42. As a result the annular collar 44*b* projects beyond the contact disc 42 when it is fitted from the right through the aperture 42*a* in the winding material contact disc 42. In that way, the annular collar 44*b* forms a positioning abutment for the clamping unit 20, with the formation of a gap between the clamping unit 20 and the winding material contact disc 42. The clamping unit 20 bears from the left against the positioning abutment upon being mounted on the rotary shaft 10, and is positioned thereby. The annular collar 44*b* forms a recess 44*c*, in which a part of the clamping unit 20 engages in the movement thereof from the clamping position into the release position, as is described in greater detail hereinafter. It is also to be noted that the cover disc 44 is mounted releasably to the winding material contact disc 42 by means of three screws (not shown).

The actuation unit 60 firstly has an elongate cylindrical intermediate sleeve 62 which is arranged on the rotary shaft 10 in coaxial relationship therewith to the left of the winding material contact disc 42. The intermediate sleeve 62 is of an inside diameter which is at least approximately equal to the outside diameter of the rotary shaft 10 in the region in which the intermediate sleeve 62 is mounted on the rotary shaft 10, and is preferably made from a material, such as for example steel, which has a low coefficient of friction in order in that way to facilitate axial sliding movement of the intermediate sleeve 62 on the rotary shaft 10, as will be discussed in greater detail hereinafter. It will be appreciated however that the intermediate sleeve 62 can also be made from a material which is identical to or similar to that of the rotary shaft 10 but which permits the sliding movement by a suitable choice of fit. There is no need to expressly emphasize the fact that a combination of a material with a low coefficient of friction and a suitable choice of fit is also possible.

In addition the intermediate sleeve 62 is connected non-rotatably but axially movably to the rotary shaft 10. In this case the intermediate sleeve 62 has an oval aperture 62*a* which is oriented in parallel relationship with the longitudinal centre line M and which is arranged in the region of the right half of the intermediate sleeve 62. Engaging into that aperture 62*a* is a fitment key 18 which is pressed into a recess 10*b* in the rotary shaft 10 and whose axial longitudinal extent is less than the axial longitudinal extent of the aperture 62*a*. That arrangement provides that the intermediate sleeve 62 is also caused to rotate when the rotary shaft 10 is rotated, but it can be displaced axially with respect to the rotary shaft 10.

In addition the actuation unit 60 includes two conversion elements 64 which are respectively arranged at the left and right ends 62*b*, 62*c* of the intermediate sleeve 62 flush with those ends 62*b*, 62*c*. The conversion elements 62 are connected non-rotatably and axially fixedly to the intermediate sleeve 62, for example by adhesive. The two conversion elements 64 are of the same shape so that hereinafter only one of the two conversion elements 64 is to be described in greater detail. In that respect it is to be pointed out that the two conversion elements are fitted on the intermediate sleeve in the same orientation, as will be described in greater detail hereinafter.

A conversion element 64 is in the shape of a circular-cylindrical sleeve whose peripheral surface 64*a*, in the installed condition, extends in at least approximately parallel relationship with the longitudinal centre line M of the rotary shaft 10 and which faces towards the left. At its left end (not identified) the conversion sleeve 64 is provided with a bevel. In addition at its right end which is also not identified the conversion sleeve 64 has a peripherally extending annular collar 64*b* which projects radially beyond the peripheral surface 64*a*. The transition from the cylindrical peripheral surface 64*a* to the surface of the collar 64*b*, which extends in at least approximately parallel relationship with the longitudinal centre line M of the rotary shaft 10 and is thus also cylindrical is formed by a surface 64*c* which, as viewed in longitudinal section, extends inclinedly at an acute angle relative to the longitudinal centre line M. The cylindrical peripheral surface 64*a*, the cylindrical collar surface 64*b* and the inclinedly or conically extending surface 64*c* of the conversion element 64 together form a cam surface for moving the carrier elements 24 of the clamping unit 20. In that respect the peripheral surface 64*a* defines a first position of the clamping unit 20, namely the release position, and the collar surface 64*b* defines a second position of the clamping unit 20, namely the clamping position, wherein the conical surface 64*c* forms the transitional surface for reaching the two above-mentioned positions, as will be described in greater detail hereinafter.

As can further be seen in particular from FIG. 1, each conversion element 64 has three grooves 64*d* which are of the same depth and which extend over its entire axial length and which are arranged at a peripheral angle of at least approximately 120° relative to each other. The limbs 24*d* of the carrier elements 24 engage into those grooves 64*d*. As can be seen from FIGS. 2 and 4, each carrier element 24 bears with its surface 24*e* which in the assembled condition faces towards the rotary shaft 10 against the cam surface portions 64*a*, 64*b*, 64*c* of the conversion elements 64 respectively in dependence on the position which is just being occupied. Accordingly there is a touching contact between the carrier element 24 and the respective conversion element 64.

The actuation unit 60 further includes a compression spring 66 which is pushed in coaxial relationship on to the intermediate element 62. The compression spring 66 serves to urge the conversion elements 64 and therewith the clamping unit 20 into the clamping position, that is to say into the position in which the conversion elements 64 are pushed with their cylindrical collar surface 64*b* and therewith the second cam surface under the carrier elements 64. That position is shown in FIG. 2.

In that case the compression spring 66 is supported against a spring sleeve 68 which is displaceable axially on the intermediate sleeve 62 and which in turn is supported against a first ring 70 which is axially displaceably fitted on the intermediate sleeve 62. As can be seen in particular from FIGS. 2 and 4, at its inside peripheral surface 68*a* the spring sleeve 68 is provided with a completely peripherally extending recess 68*b* in which the projecting part of the fitting key 18 engages in the assembled condition. The radial depth and the axial length of the recess 68*b* is greater than the radial height of the key 18 and the axial length thereof so that the sleeve 68 can move axially beyond the key 18.

Also provided between the left conversion element 64 and the spring sleeve 68 is a second ring 70 which is also axially slidably fitted on the intermediate sleeve 62. The first and second rings 70 are of the same shape which in longitudinal section is similar to the laterally reversed letter 'L'. The inside diameter of the rings 70 in this case at least approximately corresponds to the outside diameter of the intermediate sleeve 62. Shown in FIGS. 4 and 5 is a further embodiment for the second ring 70 which differs from that shown in FIGS. 2 and 3 in that the orientation of the letter 'L' is turned into the correct, that is to say readable, orientation.

Finally the actuation unit 60 is also provided with a central actuation knob 72 which is fixedly connected to the intermediate sleeve 62 at the left end 62*b* thereof. As can be seen for example from FIG. 2 the actuation knob 72 is readily accessible from the exterior.

The winding apparatus according to the invention is used as follows:

As has already been mentioned hereinbefore, at the beginning for example of a winding-up operation, the leading end of the winding material, for example the leading end of a label-carrier strip, is clamped into the clamping unit 20 in order to wind up the vacant label-carrier strip from which the labels have been dispensed. That is effected by the front end being threaded in at noses or raised portions on the carrier elements 24. Some revolutions which are implemented by hand or by means of the drive of the winding apparatus then provide that the label-carrier strip is fixed on the clamping unit 20 or the receiving unit 40 and it is thus ready for the winding-up operation.

During the winding-up operation the clamping elements 22 and the carrier elements 24 are arranged in the clamping position, that is to say the conversion elements 64 are disposed with their collar 64*b* beneath the carrier elements 24, as can be seen in particular from FIG. 2. When the winding-up operation is concluded the actuation knob 72 is actuated or pressed, whereby the intermediate sleeve 62 is displaced against the pressure force of the spring 62 towards the right in the direction of the contact disc 42. The right end 62*c* of the intermediate sleeve 62 and the right conversion element 64 in that case pass into the recess 44*c* of the cover disc 44, as is shown in FIG. 5. At the same time the two conversion elements 64 are displaced towards the right with respect to the carrier elements 24, whereby the second cam surface portion 64*b* comes out of touching contact with the carrier elements 24. The carrier elements 24 slide along the third cam surface portion 64*c* and finally pass on to the first cam surface portion 64*a*. In that way the clamping elements 22 and the carrier elements 24 can move radially inwardly in a direction towards the rotary shaft 10 (see FIGS. 5 and 6). In that case once again the diameter of the receiving unit 40 is reduced, as can be seen from FIG. 7. As therefore the outside diameter of the receiving unit 40 or the clamping unit 20 is smaller than the inside diameter of the winding material, the wound-up material can be easily withdrawn towards the left from the receiving unit 40 or the clamping unit 20. As moreover the residual tension which acts on the winding material and which is produced by the winding operation continues to urge the clamping elements 22 and the carrier elements 24 downwardly, that is to say against the pressure force of the compression spring 66, the actuation knob 72 does not have to be further pressed in that case. After withdrawal of the winding material the pressure force of the compression spring 66 which is supported in the recess 44*c* is sufficient to move the two conversion elements 64 together with the intermediate sleeve 62 towards the left, whereby once again the second cam surface portion 64*b* passes under the carrier elements 24. As a result the clamping elements 22 as well as the carrier elements 24 are moved back into the starting position, that is to say the clamping position, as can be seen from FIG. 2.

The invention claimed is:

1. An apparatus for winding or unwinding a windable material, comprising:

a rotatable, axially extending shaft, a sleeve that receives the shaft and is rotatable as a unit with the shaft, a pair of axially spaced cams fixedly secured to the sleeve, a plurality of peripherally spaced elongate clamping elements about which the winding material can be wound, the clamping elements having opposite end portions, a carrier element on each end portion of each clamping element, the carrier elements at the one end portions of the clamping elements being non-rotatably coupled to and slidable on one of the cams, the carrier elements at the other end portions of the clamping elements being non-rotatably coupled to and slidable on the other one of the cams, the sleeve and the cams being shiftable relative to the shaft in one direction to cam the clamping elements outwardly to a clamping position, and the sleeve and the cams being shiftable relative to the shaft in the opposite direction to enable movement of the clamping elements inwardly to a release position.

2. Apparatus as defined in claim 1, including a compression spring received about the sleeve and exerting force against one of the cams to normally urge the clamping members to the clamping position.

3. Apparatus as defined in claim 2, wherein the spring is further compressed when the sleeve and the cams are manually shifted in the opposite direction to bring the clamping elements to the release position.

4. Apparatus as defined in claim 2, each cam having peripherally spaced axially extending grooves, and each carrier element having a leg received in the respective groove to permit axial movement of the cams but to prevent rotation of the carrier elements relative to the cams.

5. Apparatus as defined in claim 1, including a knob on the sleeve.

6. Apparatus as defined in claim 1, including a second sleeve that receives the first-mentioned sleeve, and a spring that exerts force against the second sleeve which in turn exerts force against the carrier elements at the opposite end portions.

7. Apparatus as defined in claim 1, including a spring to normally urge the clamping elements into the clamping position.

8. An apparatus as defined in claim 1, including a knob on the sleeve pushable to move the sleeve and the cams axially relative to the clamping elements to allow the clamping elements to move to the release position.

9. Apparatus as defined in claim 1, including a knob on the sleeve fixed against axial movement relative to the sleeve.

10. Apparatus as defined in claim 1, wherein the cams are identical.

11. Apparatus as defined in claim 1, wherein the carrier elements are separate pieces which are attached to the clamping elements.

* * * * *